US005596338A

United States Patent [19]

Smith

[11] Patent Number: 5,596,338

[45] Date of Patent: Jan. 21, 1997

[54] MULTIFUNCTION ANTENNA ASSEMBLY

[75] Inventor: Terry M. Smith, La Honda, Calif.

[73] Assignee: Space Systems/Loral, Inc., Palo Alto, Calif.

[21] Appl. No.: 495,201

[22] Filed: Jun. 27, 1995

[51] Int. Cl.[6] ..... H01Q 13/02

[52] U.S. Cl. ..... 343/786; 343/776

[58] Field of Search ..... 343/786, 772, 343/776, 777, 778, 756, 909; H01Q 13/00, 13/02, 13/06

[56] References Cited

U.S. PATENT DOCUMENTS

| | | | |
|---|---|---|---|
| 3,754,272 | 8/1973 | Goldstone et al. | 343/786 |
| 3,831,176 | 8/1974 | Epis et al. | 343/786 |
| 3,896,449 | 7/1975 | Blume | 343/786 |
| 4,058,813 | 11/1977 | Risko | 343/786 |
| 4,201,956 | 5/1980 | Kienberger et al. | 343/786 |
| 5,258,768 | 11/1993 | Smith | 343/786 |

*Primary Examiner*—Hoanganh T. Le
*Attorney, Agent, or Firm*—Perman & Green

[57] ABSTRACT

An assembly of antenna elements is mounted in a unitary structure for transport on a satellite encircling the earth. Each element comprises a horn shaped radiator with opposed arcuate sidewalls, a rectangular waveguide feed, and a transition interconnecting the feed to a throat of the horn. The assembly services a plurality of portions of a communication band within the electromagnetic spectrum. The throats of respective horns are dimensioned for specific frequencies of the respective portions of the communication bands. The antenna elements may provide telemetry and control functions for the satellite. A side-by-side arrangement of the horns permits use of a common meanderline polarizer for conversion of a linearly polarized wave to a circularly polarized wave for each antenna element.

7 Claims, 2 Drawing Sheets

MULTIFUNCTION ANTENNA ASSEMBLY

BACKGROUND OF THE INVENTION

This invention relates to the configuring of individual ones of a plurality of antenna elements for emplacement of the antenna elements in a common antenna assembly suitable for use on board a spacecraft, the antenna assembly allowing independent operation of the respective antenna elements. More particularly, the invention relates to a construction of each of the antenna elements of a waveguide section and a radiating horn which are interconnected by a waveguide transition. The throat of each horn has a cross-sectional dimension commensurate with a wavelength of electromagnetic radiation to be radiated by the respective horn.

There are communication systems, such as those employing communication satellites encircling the earth, which employ a plurality of radiated signals including transmission and/or reception of telemetry signals in various frequency bands, by way of example, to be handled by a plurality of antennas. Each antenna is configured to operate in a specific frequency band, and all of the antennas are to be carried by a single satellite.

Heretofore, it has been the practice to provide a satellite with a plurality of antennas, each performing its specific function, such as communicating via a specific telemetry band. Such construction of a satellite results in a complex arrangement of the antennas.

A problem arises in that the emplacement of numerous antennas in numerous locations on board a satellite is disadvantageous because of added complexity to the construction of the satellite and because of a possible excessive amount of weight and cost.

SUMMARY OF THE INVENTION

The aforementioned problem is overcome and other advantages are provided by an antenna assembly which, in accordance with the invention, has a construction enabling the juxtaposition of plural antenna elements operative in different frequency portions of the electromagnetic spectrum in a communication band, such as a telemetry and command band, for operation on board a satellite. Each antenna element includes a horn radiator with opposed parallel arcuate sides. The horns are stacked side by side in an array of radiators which shares a common meanderline polarizer for conversion between linear and circularly polarized electromagnetic waves. The throats of the respective horns are connected via waveguide transitions to a set of waveguide feeds. The feeds all have the same dimensions, but the throats of the horns have cross-sectional dimensions specific to operating frequencies of the respective horns. Tuning screws may be placed in each of the waveguide feeds for providing a specific frequency band of operation to each of the antenna elements. Each antenna element provides its function independently of the other antenna elements. Redundant antenna elements may be included in the assembly if desired. The assembly of the antenna elements is supported readily in a common frame which facilitates positioning of the antenna assembly on board satellite.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element in the different figures but may not be referenced in the description for all figures.

DETAILED DESCRIPTION

Figure 1:
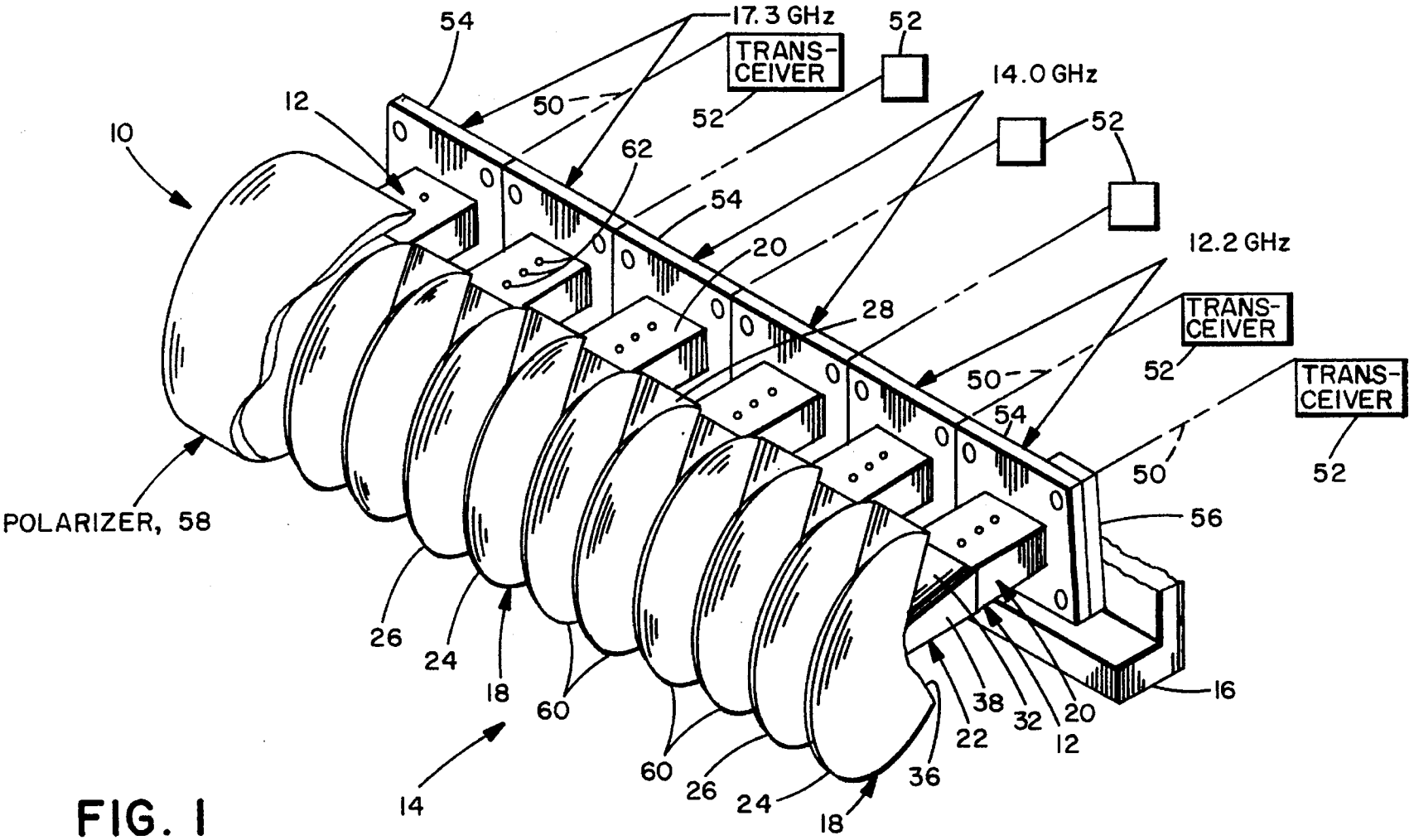
FIG. 1 shows a stylized perspective view of an antenna assembly constructed in accordance with the invention.
Figure 2:
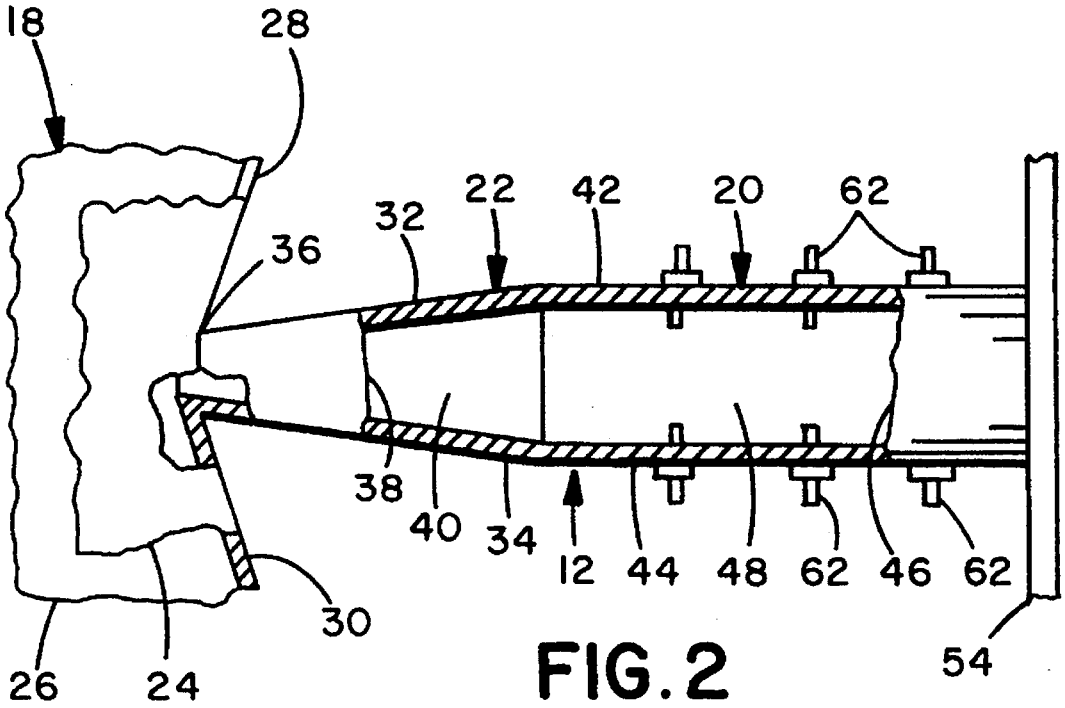
FIG. 2 shows a side view of an individual antenna element of the assembly of FIG. 1, portions of the view being sectioned to disclose constructional details.
Figure 3:
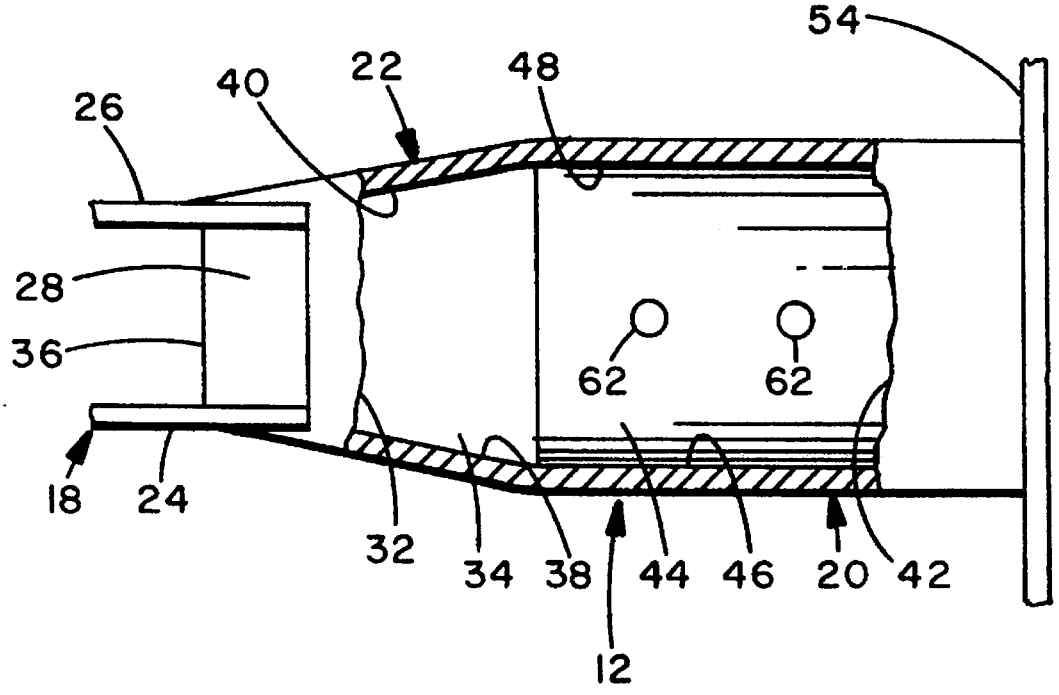
FIG. 3 shows a top view of the antenna element of FIG. 2, portions of the view being sectioned to disclose constructional details.

With reference to FIGS. 1–3, there is shown an assembly 10 of antenna elements 12. The elements 12 are held in position in an array 14 by a support 16 partially shown in FIG. 1. Each of the elements 12 comprises a radiator in the form of a horn 18, wherein the horn 18 is fed by a waveguide feed 20 connected to the horn 18 by a transition 22. Each of the transitions 22 provides a reduction in cross-sectional dimensions of height and width from a feed 20 to the corresponding horn 18. Each horn 18 comprises two parallel sidewalls 24 and 26 joined by a top transverse wall 28 and a bottom transverse wall 30 (FIG. 2). The top and the bottom transverse walls 28 and 30 meet top and bottom broad walls 32 and 34 of the transition 22 at a throat 36 of the horn 18. The transition 22 has sidewalls 38 and 40 which join the top and the bottom broad walls 32 and 34. The feed 20 comprises a section of rectangular waveguide having top and bottom broad walls 42 and 44 which are joined by sidewalls 46 and 48. The top and the bottom broad walls 32 and 34 of the transition 22 abut the top and the bottom broad walls 42 and 44 of the feed 20, and the sidewalls 38 and 40 of the transition 22 abut the sidewalls 46 and 48 of the feed 20.

Respective ones of the feeds 20 connect via respective transmission lines 50, indicated in phantom In FIG. 1, to respective transceivers 52 for transmission and/or reception of RF (radio frequency) signals. Each of the transmission lines 50 may be a coaxial line or a section of waveguide. Each of the feeds 20 include a flange 54 which abuts an end of each of the walls 42, 44, 46 and 48 of the feed 20. The flange 54 serves to connect the feed 20 to the corresponding transmission line 50 via a flange 56 (one of which is shown partially in FIG. 1) which represents a part of the transmission line 50 or a part of a transition from coax to waveguide in the case wherein the transmission line 50 is a coaxial line.

A common meanderline polarizer 58 is shared by all of the horns 18, and is positioned in front of the horns 18. The sidewalls 24 and 26 of the respective horns 18 terminate with circular edges 60 at -the respective radiating apertures of the horns 18. The circular edges 60 of the sidewalls 24 and 26 of the respective horns 18 have equal radii. The polarizer 58 has a cylindrical shape which conforms to the circular edges 60 of the sidewalls 24 and 26, and is spaced apart from the edges 60 by a spacing of approximately one quarter wavelength of the radiation transmitted from the assembly 10 at the midband frequency. Each of the feeds 20 is operative with a linearly polarized wave wherein the electric field vector is oriented perpendicularly to the broad walls 42 and 44 of the respective feeds 20. The linearly polarized waves transmitted by the respective antenna elements 12 interact with the polarizer 58 to produce circularly polarized waves. Operation of the assembly 10 is reciprocal so that an incoming circularly polarized electromagnetic wave is converted by the polarizer 58 to a linearly polarized wave incident upon the respective horns 18.

By way of example in the construction of the assembly 10, the overall operating bandwidth may extend over approximately one octave of the electromagnetic spectrum. In accordance with a preferred embodiment of the invention, the overall operating bandwidth may be subdivided into a set of three narrower bands centered respectively at 12.2 GHz (gigahertz), 14.0 GHz and 17.3 GHz, these frequencies being indicated in FIG. 1. All of the feeds 20 have rectangular cross sections, the respective cross-sectional dimensions of the respective feeds 20 being equal. All of the horn throats 36 have rectangular cross sections, but the dimensions of the cross sections vary among the throats 36 depending on the frequency of the radiation to be radiated by the respective horns 18. This provides the cross-sectional dimensions in the horn throats of respective ones of the antenna elements with sizes commensurate with the wavelengths of the respective radiations. The cross-sectional dimensions of each of the respective throats 36 are approximately the same as the corresponding dimensions of a rectangular waveguide operating at the same frequency. Accordingly, with reference to the foregoing example of operating frequency bands, signals at the 12.2 GHz frequency would be below the cutoff frequency of an antenna element 12 operating at a frequency of 17.3 GHz. The reduction in cross section provided by each of the transitions 22 is in two dimensions, height and width, so as to retain the aspect ratio of the respective feed 20.

The horns 18 are spaced apart from each other to reduce mutual coupling among signals radiated and/or received by the respective horns 18. By way of example, a spacing in the range of one half wavelength to one wavelength may be employed between the sidewall 24 of one horn 18 and the sidewall 26 of the adjacent horn 18. It is also advantageous to tune each of the feeds 20 to its respective operating frequency band. Such tuning may be accomplished by use of tuning screws 62 of which three screws 62 are provided, by way of example, in each of the broad walls 42 and 44 of the feeds 20. Typical spacing between successive ones of the screws 62 in any one of the broad walls 42, 44 of a feed 20 is approximately one quarter of the guide wavelength at the midband frequency of the feed 20.

In the example of construction of the assembly 10 in FIG. 1, redundant operation is provided for each of the operating bands by providing two identical antenna elements 12 for each of the operating bands designated by the frequencies 12.2 GHz, 14.0 GHz and 17.3 GHz. Furthermore, as mentioned above, the circular sectors of the edges 60 of the horn sidewalls 24 and 26 have equal radii. Also, as portrayed in FIG. 1, the circular sectors of the respective sidewalls 24 and 26 extend through equal angles of arc. This equality of horn sidewall configuration provides substantially equal angular coverage in the radiation patterns of the respective horns 18. However, if desired, the radii and the angular extent of the respective circular sectors of the horns 18 maybe varied among the horns 18 to provide for different angular coverage in the radiation patterns of the respective horns 18.

The foregoing construction of the assembly 10 of antenna elements 12 provides for multiple band, wide angle telemetry and command communication functions on a satellite at the foregoing three frequency bands simultaneously. The circular polarization provided by the assembly 10 has a low axial ratio for improved performance. The resulting physical configuration is compact for facilitating construction of spacecraft.

It is to be understood that the above described embodiments of the invention are illustrative only, and that modifications thereof may occur to those skilled in the art. Accordingly, this invention is not to be regarded as limited to the embodiments and/or frequency bands disclosed herein, but is to be limited only as defined by the appended claims.

What is claimed is:

1. An antenna assembly comprising a plurality of antenna elements operative with radiation in different frequency portions of the spectrum, and means for holding said antenna elements in a side-by-side arrangement;

wherein each of said antenna elements comprises:

a radiating horn having two opposed planar parallel sidewalls and two transverse walls interconnecting the sidewalls;

a rectangular waveguide feed having cross-sectional dimensions of width and height;

a transition interconnecting said feed to a throat of said horn, said throat having cross-sectional dimensions of width and height, wherein the cross-sectional dimensions of width and height of said throat are smaller than the corresponding cross-sectional dimensions of said feed;

wherein the cross-sectional dimensions in the horn throats of a plurality of said antenna elements differ in size from the horn throat of another of said antenna elements;

the cross-sectional dimensions in the horn throats of respective ones of said antenna elements have sizes commensurate with the wavelengths of the radiation, which radiation is to be transmitted and/or received by respective ones of said antenna elements;

the relationship of commensurate throat sizes and wavelengths provides for a larger throat size for a radiation of longer wavelength and a smaller throat size for a radiation of shorter wavelength; and wherein the horns of respective ones of said antenna elements are spaced apart from each other with the sidewalls of said respective horns being parallel to each other to provide for a compact configuration to the antenna assembly.

2. An antenna assembly according to claim 1 further comprising a meanderline polarizer configured for interfacing with mouths of respective ones of said horns for conversion between linear and circular polarized waves of the radiation.

3. An antenna assembly according to claim 2 wherein said meanderline polarizer has a cylindrical shape, and each of said sidewalls of respective ones of said horns has an outer substantially circular sector shape.

4. An antenna assembly according to claim 3 wherein sidewalls of said horns of adjacent ones of said antenna elements are spaced apart by a distance in a range of approximately one-half wavelength to one wavelength of the mean frequency of radiation radiated by said adjacent antenna elements.

5. An antenna assembly according to claim 4 wherein each of said antenna elements further comprises tuning means disposed within said waveguide feed.

6. An antenna assembly according to claim 5 wherein each of said tuning means comprises a plurality of tuning screws disposed within a wall of said waveguide feed of an individual one of said antenna elements.

7. An antenna assembly according to claim 2 wherein said meanderline polarizer is operative at all of said frequency portions of the spectrum simultaneously.

* * * * *